US005799936A

United States Patent [19]

Sekine et al.

[11] Patent Number: 5,799,936

[45] Date of Patent: Sep. 1, 1998

[54] AUTOMATIC DEVICE FOR DIVERTING LARGE SHEETS OF PAPER TO A BAR

[75] Inventors: Masahiro Sekine; Masami Maruyama, both of Kawasaki, Japan

[73] Assignee: Japan Digital Laboratory Co., Ltd., Tokyo, Japan

[21] Appl. No.: 766,133

[22] Filed: Dec. 16, 1996

[30] Foreign Application Priority Data

Jan. 18, 1996 [JP] Japan ..... 8-024654

[51] Int. Cl.[6] ..... B65H 29/54; B07C 5/04

[52] U.S. Cl. ..... 271/175; 271/303; 271/288; 271/298; 209/586

[58] Field of Search ..... 271/290, 175, 271/298, 288, 176, 303; 209/586, 657, 658

[56] References Cited

U.S. PATENT DOCUMENTS

| | | | |
|---|---|---|---|
| 4,361,320 | 11/1982 | Kikuchi et al. | 271/290 |
| 4,804,174 | 2/1989 | Ter Horst | 271/175 |
| 4,927,031 | 5/1990 | Martin | 209/657 |
| 5,179,880 | 1/1993 | Sherick | 271/175 |
| 5,184,734 | 2/1993 | Yamaguchi | 209/657 |
| 5,188,352 | 2/1993 | Bartman et al. | 271/175 |
| 5,603,494 | 2/1997 | Baker et al. | 271/303 |

FOREIGN PATENT DOCUMENTS

| | | | |
|---|---|---|---|
| 5-58532 | 3/1993 | Japan . | |
| 406024624 A | 2/1994 | Japan | 271/303 |
| 406144670 A | 5/1994 | Japan | 271/303 |
| 406144673 A | 5/1994 | Japan | 271/303 |
| 406144676 A | 5/1994 | Japan | 271/303 |
| 406144683 A | 5/1994 | Japan | 271/175 |
| 406144685 A | 5/1994 | Japan | 271/303 |
| 406234453 A | 8/1994 | Japan | 271/175 |
| 406234454 A | 8/1994 | Japan | 271/175 |
| 6-255869 | 9/1994 | Japan . | |
| 7-215671 | 12/1995 | Japan . | |

*Primary Examiner*—William E. Terrell
*Assistant Examiner*—Patrick Mackey
*Attorney, Agent, or Firm*—Flynn, Thiel, Boutell & Tanis, P.C.

[57] ABSTRACT

A sheet stacking apparatus having a frame with an inlet for sheet stock and first and second sheet receiving structures. A sheet guide member is provided and is movable between positions for facilitating guiding of the sheet stock to a respective one of the first and second sheet receiving structures. A sheet stock size selection device produces control signals indicative of a size of the sheet stock inputted at the inlet. A control device is responsive to the control signals for controlling movement of the sheet guide member. The sheet guide member includes a clamp member thereon movable into and out of engagement with a support in one of the sheet receiving regions to physically hold the sheet stock delivered thereto in place. The sheet guide member additionally includes an auxiliary roller and a lever arm with a linkage interconnecting the lever arm, the sheet guide member and the sheet clamp member. Thus, sheet stock fed to the inlet will cause the control device, in response to a first of the control signals indicative of a sheet stock of a first size, movement of the sheet guide member to a first position to guide the sheet stock to the first receiving region or, in response to a second of the control signals indicative of sheet stock of a second size, movement of the sheet guide member to the second position to guide the sheet stock to the second receiving region.

12 Claims, 13 Drawing Sheets

AUTOMATIC DEVICE FOR DIVERTING LARGE SHEETS OF PAPER TO A BAR

FIELD OF THE INVENTION

The present invention relates to an automatic device for stacking sheets of paper suitable for a drawing printing output device in a field of electronic apparatuses such as a CAD device using a computer and in particular to an automatic device for stacking sheets of paper, which is mounted on a device such as a large scale plotter, a facsimile, a copier, etc. to stack automatically a great number of sheets of paper outputted from this device.

DESCRIPTION OF THE PRIOR ART

Recently, in a drawing processing field such as CAD, etc., it is usual to improve business efficiency and economization by using a large scale printer such as an LED plotter, etc., a printer, a copier, etc. in common in a network. In case where a large scale printer such as an LED plotter, etc., a copier, etc. are used in common in a network, it is indispensable that drawings, which are outputted results, can be taken out and put in order in a simple manner and it is expected that utilization efficiency of an output device used in common can be significantly improved, if output sheets of papers having various sizes including large size sheets of paper outputted at a high speed can be put in order, classifying them in size in a form, in which they can be easily taken out.

In order to meet such a requirement, it is necessary to improve a structure of a stacking device for stacking output sheets. However, since almost all of prior art stacking devices were so constructed that sheets of paper were stacked in a horizontal or almost horizontal form, there were inconveniences in ensuring a sufficient space therefor or in taking-out and putting-in-order thereof.

In the construction, in which outputted sheets of paper are stacked in a horizontal or almost horizontal form as in the prior art stacking devices, a section for stacking sheets of paper should have an area, which is at least equal to or greater than the area of the sheets of paper and in addition the stacking section should have supporting means, which is forcedly great and rigid.

As stacking devices constructed according to a principle different from that of the construction, in which sheets of paper are stacked in a horizontal or almost horizontal form as in the prior art stacking devices, there are known devices for stacking sheets of paper disclosed in JP-A-Hei 5-58532, JP-A-Hei 6-255869 and JP-A-Hei 7-315671.

The stacking device disclosed in JP-A-Hei 5-58532 is so constructed that an output shaft of a motor 6 is linked with a part of a driving shaft 4 rotatably supported so as to be parallel to a sheet sending out opening 3, through which sheets of paper 1 are sent out from a drawing output device 2, through transmitting means 5, as indicated in FIG. 14 herein, so that the driving shaft 4 can be rotated by the motor 6 to effect following operations. An arm 7 is secured to each of the ends of the driving shaft 4 and protrudes outwards through a slit formed in a vertical wall 8, in which the sheet sending out opening 3 is formed. A sheet hanging bar 9 is disposed in parallel to the sheet sending out opening 3 so as to tie the extremities of the two arms 7,7. In case where a sheet of paper 1 is continuous, when the sheet of paper 1 is sent out by a predetermined length, the sheet hanging bar 9 is pivoted upward to bring the sheet of paper 1 into contact with a contacting piece 14*a* disposed on the lower surface of the extremity of a stopper 14 through an elastic supporting bar 14*b*. The sheet of paper 1 is put between the contacting piece 14*a* and the sheet hanging bar 9 in this way and cut in this state. Thereafter the sheet hanging bar 9 returns to its initial position.

However, since the above stacking device is so constructed that the sheet hanging bar 9 is pivoted every time the sheet 1 is sent out and that the cut sheet 1 is hung to be held and since the sheet hanging bar 9 plays both a role of dividing the sheet into halves and a role of hanging it, when the number of hung sheets of paper exceeds a predetermined value, rotation load of the sheet hanging bar 9 becomes too great due to weight of the hung sheets. Therefore there was a problem that the number of sheets, which can be stacked, is restricted and that a driving system becomes inevitably great, if it is desired to improve this restriction.

As techniques proposed for solving the above problem, there is known an "automatic stacking device" (refer to FIG. 15 herein) disclosed in JP-A-Hei 6-255869.

The above stacking device is composed of sheet supporting means 23 disposed below a sheet sending out section 20 of a drawing output device; sheet sending out direction changing means 22, which is movable up- and down-ward to change the sheet sending out direction from one to another side by pushing the sheet supporting means 23; and a sheet rectifying plate 21, which is movable upward and downward to guide a sheet sent out from the sheet sending out section 20 to one side of the sheet supporting means 23, as indicated in FIG. 15, and works as indicated below.

A sheet of paper P sent out from the sheet sending out section 20 is guided to the outer side of a fixed bar 23*c* of the sheet supporting means 23 by the sheet rectifying plate 21. When the length of the sent out sheet P reaches about a half of a predetermined length, a pivoting bar (sheet sending out direction changing means) 22 descends. The pivoting bar 22 descends further also after it has been brought into contact with the sheet P, until it is brought into contact with the fixed bar 23*c*. As a result, the sheet P is hung also on the inner side of the fixed bar 23*c*. The sheet P is cut by a cutter (not shown in the figure), when the length thereof reaches a predetermined value and the pivoting bar 22 returns to the initial position thereof.

However, in the above techniques although the pivoting bar 22 moved, when the length of the sheet P reached about a half of the predetermined value, to help hanging of the sheet P on the fixed bar 23*c*, they had a problem that when the number of hung sheets increased, hanging state became unstable and the sheets might be deviated from a predetermined position.

As techniques proposed for solving the problem of the above automatic stacking device, there is known an "automatic stacking device" (refer to FIG. 16 herein) disclosed in JP-A-Hei 7-315671.

The above stacking device is composed of sheet supporting means 23 disposed below a sheet sending out section 20 of a drawing output device; sheet thrusting means 25, which is movable upward and downward and thrusts a sent out continuous sheet of paper towards the sheet supporting means 23, when the length thereof reaches a predetermined value; sheet sending out direction changing means 22, which is movable upward and downward to change the sheet sending out direction from one to another side of the sheet supporting means 23; and a sheet rectifying plate 21, which is movable up- and down-ward to guide the sheet sent out from the sheet sending out section 20 to one side of the sheet supporting means 23, as indicated in FIG. 16, and works as indicated below.

A sheet of paper P sent out from the sheet sending out section 20 is guided to the outer side of a fixed bar 23*c* of the sheet supporting means 23 by the sheet rectifying plate 21. When the length of the sent out sheet P reaches about a half of a predetermined value, the sheet rectifying plate 21, the sheet sending out direction changing means 22 and the sheet thrusting means 25 descend and the sheet of paper is hung on the inner side of the fixed bar 23*c* after it has been pushed towards the fixed bar 23*c*. When the overall length of the sheet P reaches the predetermined value, it is cut. Thereafter the sheet rectifying plate 21, the sheet sending out direction changing means 22 and the sheet thrusting means return to the initial positions thereof. In this way the problem of the stacking device disclosed in JP-A-Hei 5-58532 has been solved and it has become possible to stack stably 100 to 150 sheets of paper.

However there exist no paper stacking devices yet, which can stack outputted sheets of paper of various sizes, i.e. from size E (norm) to size A (norm), arbitrarily classifying them in size, and which can be universally used for drawing output devices such as an arbitrary large scale printer, a copier, etc. Although the "automatic device for stacking sheets of paper" disclosed in JP-A-Hei 7-315671 can hang outputted large scale sheets of paper in a form where they can be easily taken out, it has a problem that it is not suitable for stacking outputted sheets of paper of middle or small size and since the requirement described previously is inevitable, i.e. it is indispensable that drawings, which are outputted results, can be taken out easily and put in order in a simple manner, in case where a large scale printer such as an LED plotter, etc., a copier, etc. are used in common in a network, because recently it is usual to increase business efficiency to improve economization in a drawing processing field such as CAD, etc. by using a large scale printer such as an LED plotter, etc., a copier, etc. in common in the network, it cannot meet satisfactorily an expectation that the common utilization efficiency of the output device can be significantly increased, if output results of various sizes including large scale sheets of paper outputted at a high speed can be put in order by classifying them in size in a form, in which they can be easily taken out.

SUMMARY OF THE INVENTION

The present invention has been made in order to solve the problem and to meet the requirement described previously and the object thereof is to provide an automatic device for stacking sheets of paper, which is so constructed that large scale sheets of paper are hung and sheets of paper of middle or small size are stacked in respective trays so that it is possible to stack outputted sheets of paper, putting them in order, independently from the size thereof, and more concretely speaking, a sheet stacking device, which can stack outputted sheets of paper of various sizes, i.e. from size E (norm) to size A (norm), arbitrarily classifying them in size, and which can be universally used for drawing output devices such as an arbitrary large scale printer, a copier, etc.

In order to achieve the above object, an automatic device for stacking sheets of paper according to a first embodiment of the invention is characterized in that it comprises sheet stacking means including a stacking section for stacking sheets of paper and a sheet carrying path for carrying sheets of paper to the stacking section; sheet supporting means for hanging sheets of paper thereon; means for determining how to stack sheets of paper, which determines on the basis of the size of sheets of paper sent out from an output device whether they should be stacked in the sheet stacking section or hung on the sheet supporting means and at the same time controls a sheet guiding means driving system; the sheet guiding means driving system, which makes sheet guiding means work on the basis of a control signal from the means for determining how to stack sheets of paper; sheet guiding means, which is pivoted by the sheet guiding means driving system and guides the sheets sent out from an output device towards a carrying path of the sheet stacking means or in a direction to the sheet supporting means; and sheet thrusting means, which works, following the sheet guiding means driving system, and pushes the sheets of paper hung on the sheet supporting means towards the sheet supporting means.

An automatic device for stacking sheets of paper according to a second embodiment of the invention is characterized in that it is provided with a plurality of stacking sections acting as an automatic sheet stacking device capable of stacking sheets of paper, depending on the norm thereof and carrying paths corresponding thereto, and comprises sheet supporting means for hanging sheets of paper thereon; means for determining how to stack sheets of paper, which determines on the basis of the size of sheets of paper sent out from an output device whether they should be stacked in corresponding stacking sections in the sheet stacking means or hung on the sheet supporting means and at the same time controls a sheet guiding means driving system; the sheet guiding means driving system, which makes sheet guiding means work on the basis of a control signal from the means for determining how to stack sheets of paper; sheet guiding means, which is pivoted by the sheet guiding means driving system and guides the sheets sent out from an output device towards corresponding carrying paths in the sheet stacking means or in a direction to the sheet supporting means; and sheet thrusting means, which works, following the sheet guiding means driving system, and pushes the sheets of paper hung on the sheet supporting means towards the sheet supporting means.

A third embodiment of the invention is characterized in that the automatic device for stacking sheets of paper comprises further a mounting section for mounting the automatic device for stacking sheets of paper on an output device, putting a sheet receiving opening for receiving sheets of paper sent out from a sheet sending out opening of the latter adjacent thereto; and an information input section for receiving sheet size information on a size of the sheets of paper sent out from the output device, wherein the means for determinating how to stack sheets of paper has a control section, which decides on the basis of the information on the size of the sheets of paper received from the drawing output device whether the sheets of paper should be stacked in the stacking section or hung on the sheet supporting means and at the same time outputs a control signal to the sheet guiding means driving system.

A fourth embodiment of the invention is characterized in that in the automatic device for stacking sheets of paper according to the first or second embodiment of the invention, the means for determining how to stack sheets of paper includes means for detecting the size of the sheets of paper, which detects the size of the sheets of paper sent out from the output device and outputs sheet size information and a control section, which decides on the basis of the sheet size information whether the sheets of paper should be stacked in the stacking section or hung on the sheet supporting means and at the same time outputs a control signal to the sheet guiding means driving system.

A fifth embodiment of the invention is characterized in that the automatic sheet stacking device according to the first or second embodiment of the invention comprises further an input section for inputting previous sheet size information on the size of the sheets of paper sent out from the output device, wherein the means for determining how to stack sheets of paper includes a control section, which decides on the basis of the inputted information on the size of the sheets a paper whether the sheets of paper should be stacked in the stacking section or hung on the sheet supporting means and at the same time outputs a control signal to the sheet guiding means driving system.

A sixth embodiment of the invention is characterized in that the automatic sheet stacking device according to the fourth or fifth embodiment of the invention comprises further a mounting section for mounting the automatic device for stacking sheets of paper on an output device, putting a sheet receiving opening receiving sheets of paper sent out from a sheet sending out opening of the latter adjacent thereto, and a height adjusting section capable of adjusting the height thereof.

A seventh embodiment of the invention is characterized in that in the automatic sheet stacking device according to either one of the first to sixth embodiment of the inventions, wherein the sheet guiding means driving system includes a motor; a motor driving section; a driving shaft driven by the motor; pivoting means pivotably mounted on the driving shaft; and sheet guiding means, which is pivoted upward and downward by the pivoting means, one end of the sheet guiding means being pivotably supported to guide the sheets of paper towards the other end thereof, which is not supported pivotably, wherein the motor is driven by giving the motor driving section the control signal outputted by the means for determining how to stack sheets of paper to guide the sheets of paper, which are sent out by making the pivoting means pivot in the forward and backward directions to pivot the sheet guiding means upward and downwards, towards the carrying paths in the sheet stacking means or the sheet supporting means.

An eighth embodiment of the invention is characterized in that in the automatic sheet stacking device according to the seventh embodiment of the invention, there is disposed a rotational angle detecting device detecting a rotational angle of the pivoting means to output a detection signal in the neighborhood of the pivoting means and the control section outputs a control signal on the basis of the sheet size information and the detection signal.

DESCRIPTION OF THE PREFERRED EMBODIMENTS

Figure 1:
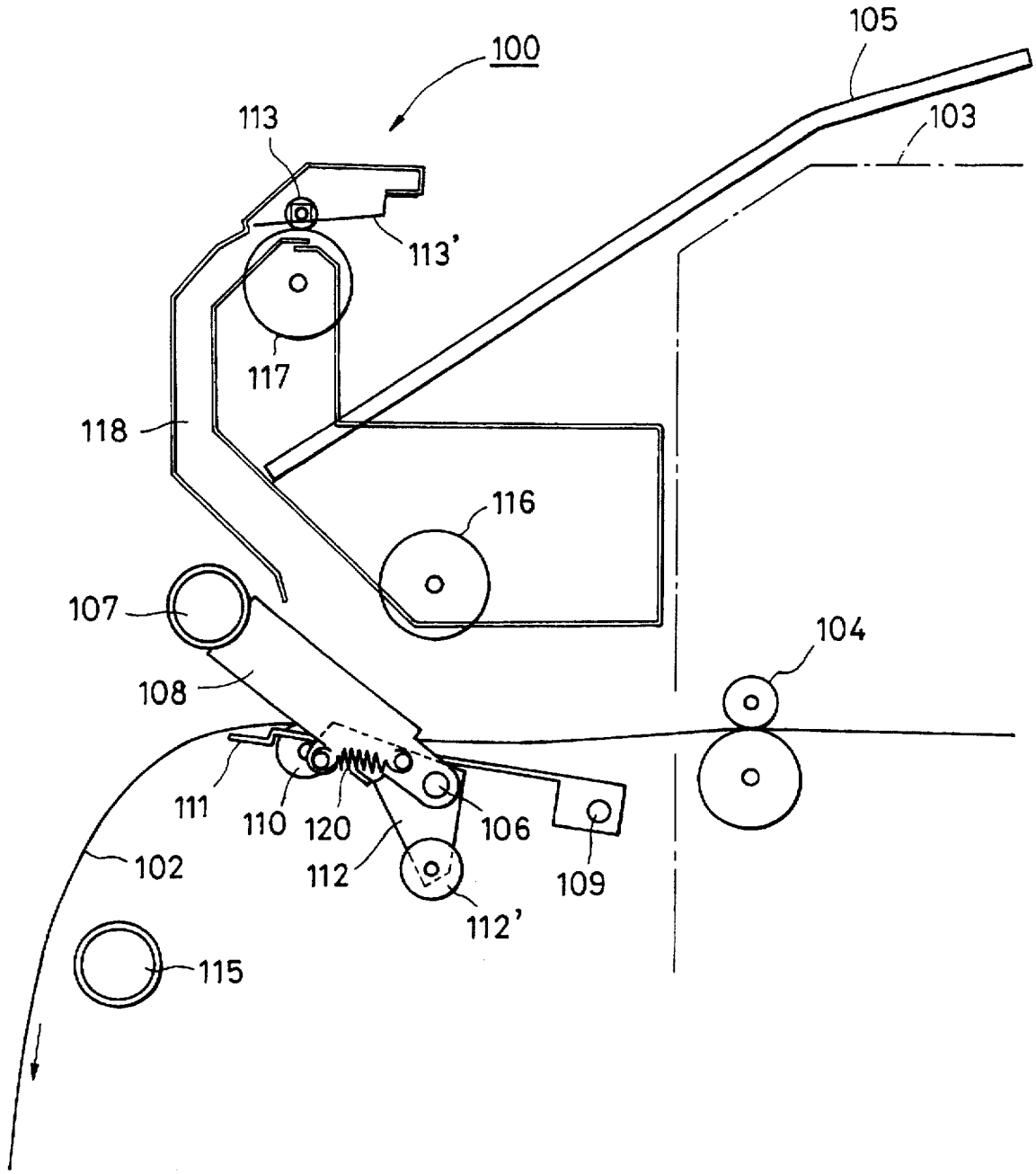
FIG. 1 is a diagram showing a principal part of an automatic device for stacking sheets of paper according to the present invention.
Figure 10B:
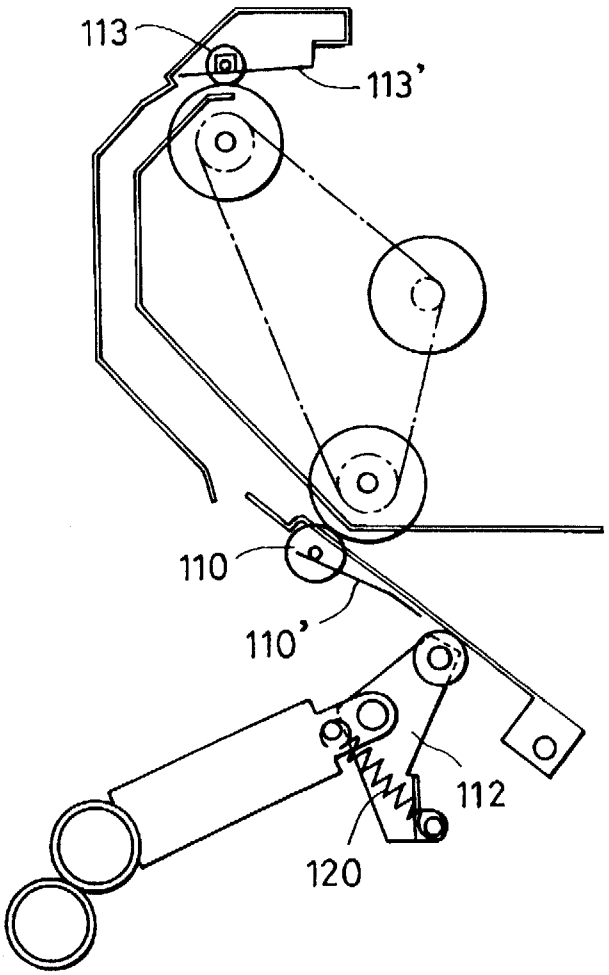
FIGS. 10A and 10B are cross-sectional views showing an example of a principal part of the automatic sheet stacking device.
Figure 10A:
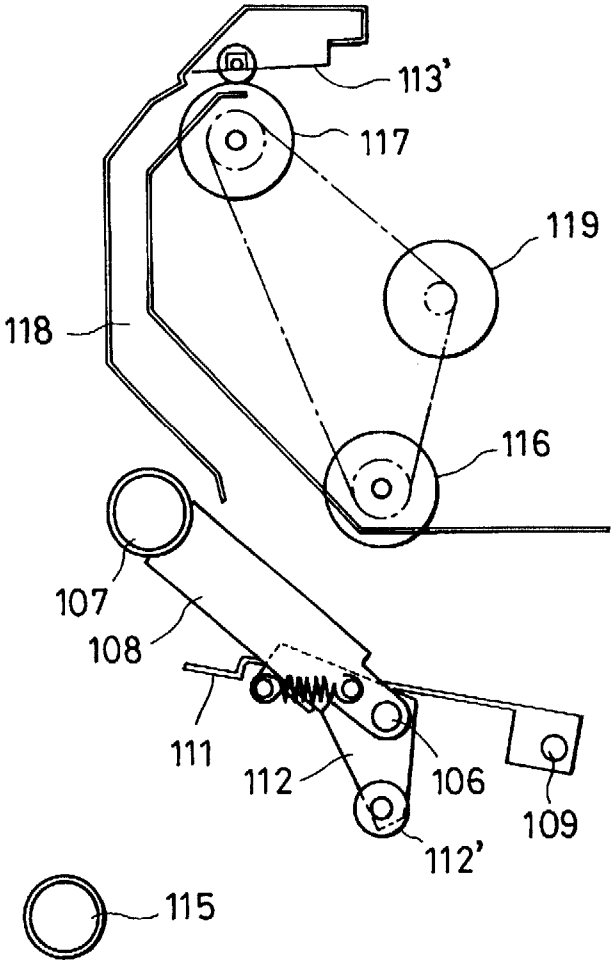

FIG. 1 is a diagram showing schematically an automatic device for stacking sheets of paper according to the present invention. (A diagram showing a principal part thereof in detail is indicated in FIGS. 10A and 10B.)

In FIG. 1, reference numeral 100 is an automatic device for stacking sheets of paper; 105 is a tray; 106 is a driving shaft of a sheet thrusting means; 107 is the sheet thrusting means; 108 is an arm of the sheet thrusting means; 109 is a supporting shaft of a sheet guiding means; 110 is an auxiliary roller disposed in the sheet guiding means; 111 is the sheet guiding means; 112 is a sheet guiding plate pivoting means supported pivotably by the driving shaft 106, which has a protrusion-shape or a tongue-shaped projection; 112' is a roller disposed on the extremity portion on the sheet guiding plate pivoting means; 113 is an auxiliary roller used in case where sheets of paper are stacked on the tray 105 side; 115 is sheet supporting means including a sheet hanging bar, on which large scale sheets of paper are hung; 116 and 117 are main rollers for carrying sheets of paper; and 118 is a carrying path for carrying sheets of paper carried by the main rollers 116 and 117 to the tray 105, in case where the sheets of paper are stacked on the stacking tray 105 side. Further, although it is not shown in the figure, an input terminal for receiving sheet size information sent from a drawing output device through a connector (not shown in the figure) is disposed on the back surface of the automatic device for stacking sheets of paper. In addition, there may be disposed a sensor (e.g. limiter switch or optical sensor), which supervises a working domain of the sheet guiding plate pivoting means 111, in the neighborhood thereof.

In FIG. 1, 102 to 104 represent items, which do not belong to the principal part of the automatic device for stacking sheets of paper 100, but are indicated in the figure for explanation. 102 represents a sheet of paper and 103 is a drawing output device sending out output sheets to the automatic device for stacking sheets of paper 100, which is an output device such as e.g. a plotter, a printing device, etc. Further 104 represents a sheet sending out section of the drawing output device 103.

Figure 2:
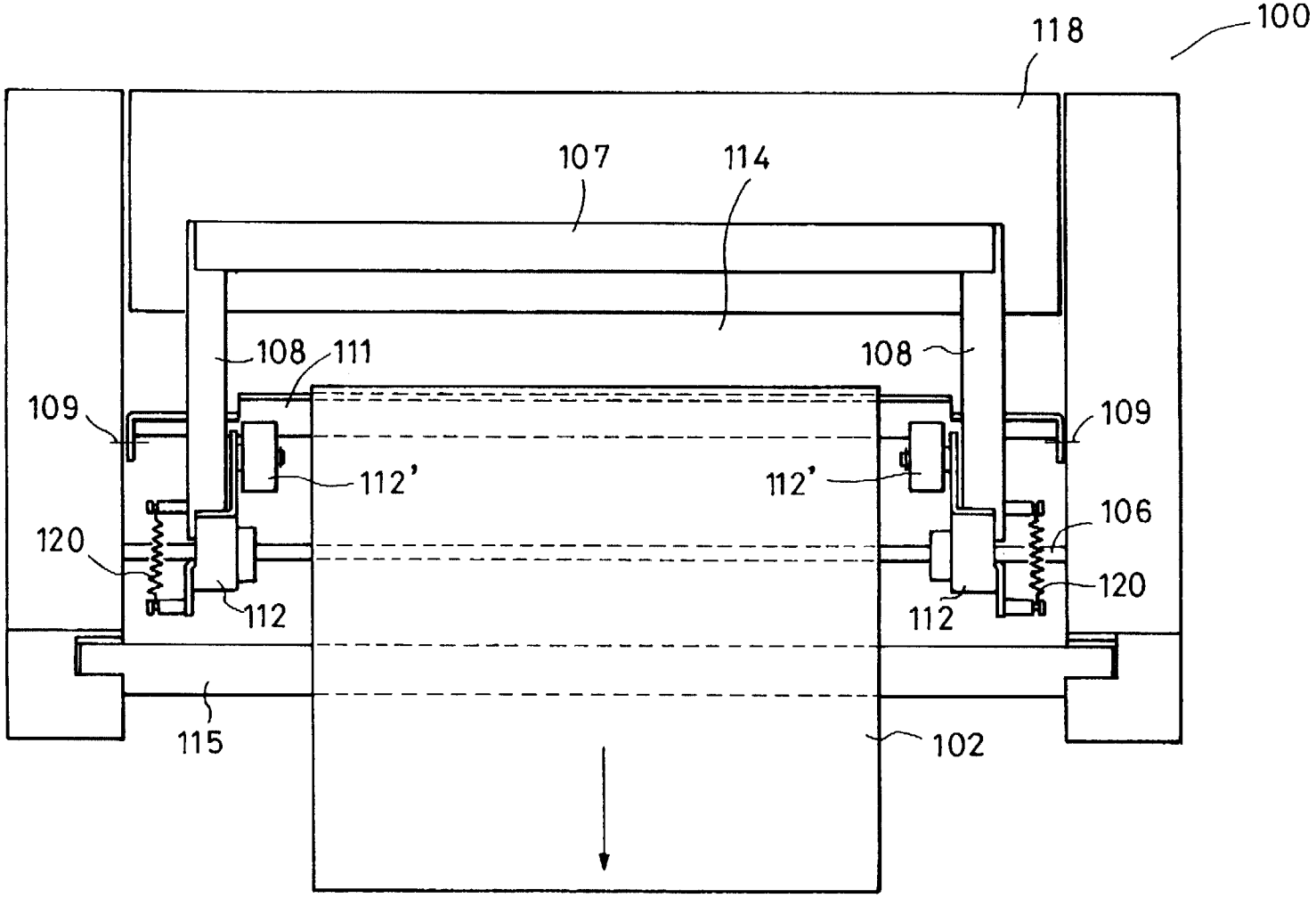
FIG. 2 is a front view of sheet thrusting means and sheet guiding means in the automatic device for stacking sheets of paper indicated in FIG. 1.
Figure 3A:
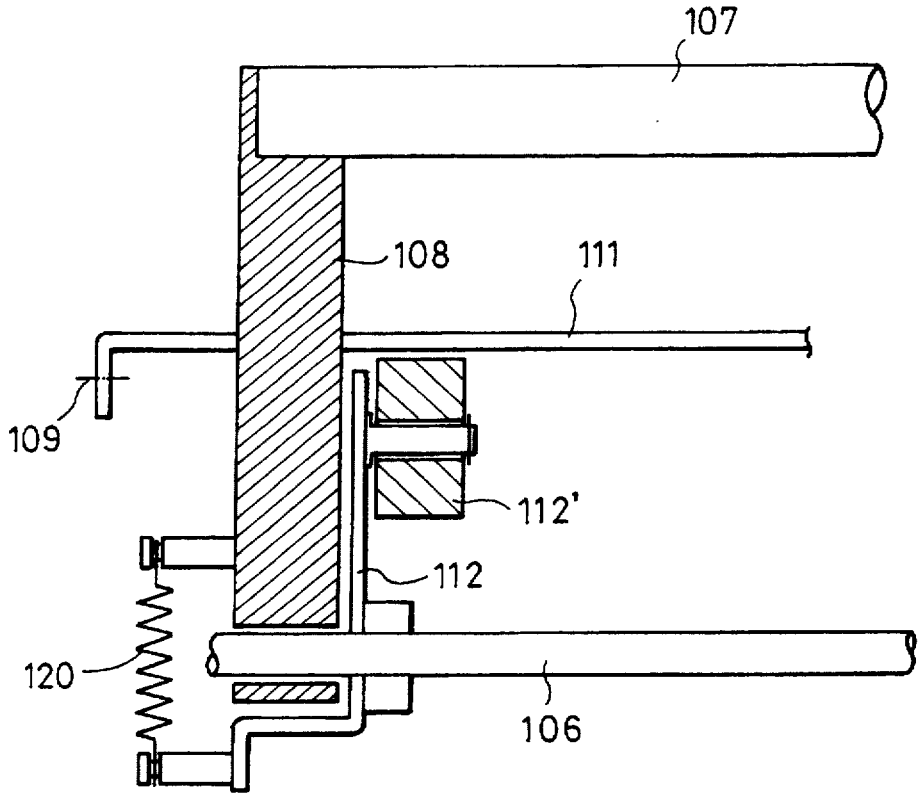
FIG. 3A is a diagram of an example of construction of sheet guiding plate pivoting means and the sheet thrusting means.
Figure 3B:
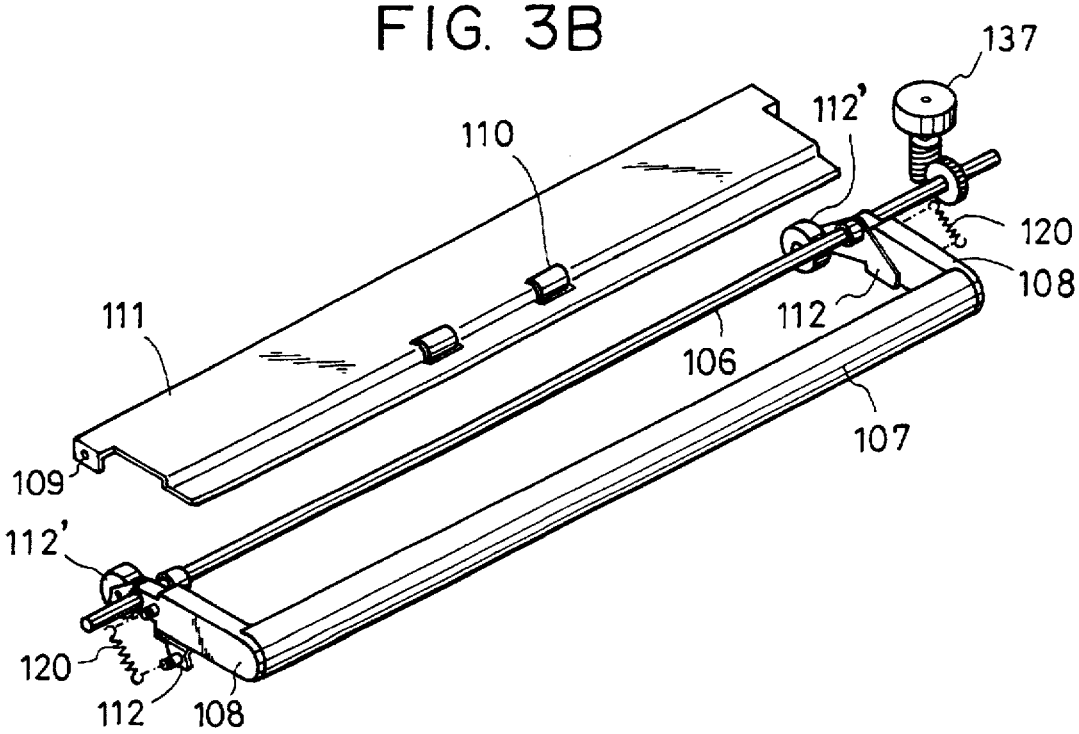
FIG. 3B is a perspective view thereof.

FIG. 2 is a front view of the sheet thrusting means 107 and the sheet guiding means 111 of the automatic device for stacking sheets of paper 100, seen from the front (from the side of the sheet sending out section 104). FIG. 3A is an enlarged partial diagram of the sheet guiding plate pivoting means 112 supported so as to pivot on the driving shaft and the sheet thrusting means 107 and FIG. 3B is a perspective view of the sheet guiding plate pivoting means 112 and the sheet thrusting means 107.

Here, as described later, a sheet guiding plate can be used for the sheet guiding means and a moving bar (FIG. 1) or a moving angle (FIG. 11) can be used for the sheet thrusting means 107. For the sheet guiding plate pivoting means 112 a driving arm (FIG. 1) or a cam (FIG. 12) can be used.

In FIG. 2 there are indicated the supporting arms 108—108 mounted on the two extremities of the driving shaft 106 so as to pivot and be pivoted by the driving shaft 106, the moving bar (sheet thrusting means) 107 mounted on the extremities of the supporting arms 108—108 so as to pivot, and the sheet guiding plate (sheet guiding means) 111 pivoted around the supporting shaft 109 by being pushed by the roller 112' mounted on the extremities of the drive arms (sheet guiding plate pivoting means) 112 supported by the driving shaft 106 by rotation thereof. Each of the supporting arms 108 and each of the drive arms 112 are linked through a spring (arm spring) 120.

The width of the sheet guiding plate 111 is smaller than the distance between the two supporting arms 108—108 so that it can pivot also between the supporting arms 108—108 and the length of the sheet guiding plate 111 is so decided that the sheet 102 sent out from the sheet sending out opening 104 is guided on the outer side of the sheet hanging bar (sheet supporting means) 115 and hung there, when the sheet guiding plate 111 is held in an approximately horizontal state between the supporting arms 108—108. The auxiliary roller 110 is disposed in the neighborhood of the extremity of the sheet guiding plate 111 and it is mounted thereon in such a position that it is brought into contact with the main roller 116, when the sheet guiding plate 111 is pivoted upward (refer to FIG. 8C).

A space 114 formed by the moving bar 107 and the sheet guiding plate 111 between the supporting arms 108—108 is one disposed for making the sheet 102 pass therethrough, in case where the sheet is hung on the sheet hanging bar 115.

In FIGS. 3A and 3B, each of the drive arms 112 is supported pivotably by inserting the driving shaft 106 therethrough and the supporting arms 108 supporting the moving bar 107 are mounted on the driving shaft 106 pivotably and freely approximately in such a degree that it can slide thereon. Since the supporting arms 108 are pivotably supported by the drive arms 112, they move, following movement of the drive arms 112 pivoted by pivot of the driving shaft 106 driven by a motor 137 through a worm gear. Since the supporting arms 108 are linked by the arm springs 120, the drive arms 112 can pivot further also after the moving bar 107 has reached the hanging bar 115 or the sheet hung thereon. Therefore, since the sheet is pushed continuously to the hanging bar 115, it is prevented for the sheet 102 to slip down from the hanging bar 115.

FIGS. 4, 5A, 5B and 5C are control block diagrams for the automatic device for stacking sheets of paper 100. In the automatic device for stacking sheets of paper indicated in FIGS. 1 to 4 and FIGS. 5A, 5B and 5C, the means for determining how to stack sheets of paper 101 decides whether the sheets of paper 102 sent out from the sheet sending out opening 104 of the drawing output means 103 should be stacked on the stacking tray 105 or hung on the sheet hanging bar 115, depending on the size of the sheets of paper, and sends a control signal to a drive control section 106 for the driving motor 137 driving the driving shaft 106 to guide the sent out sheets of paper to the stacking tray 105 or the sheet hanging bar 115 by making the drive arms 112 and the sheet guiding plate 111 move upward and downward around the shaft 109 by controlling the number of rotation or the rotation angle of the driving motor 137. Although it is not indicated in the figures, the means 101 for determining how to stack sheets of paper 101 gives a drive control section (not indicated in the figures) for a feeding motor 119 a control signal to rotate the feeding motor 119.(FIG. 10A) when a sheet of paper 102 is outputted.

Figure 4:
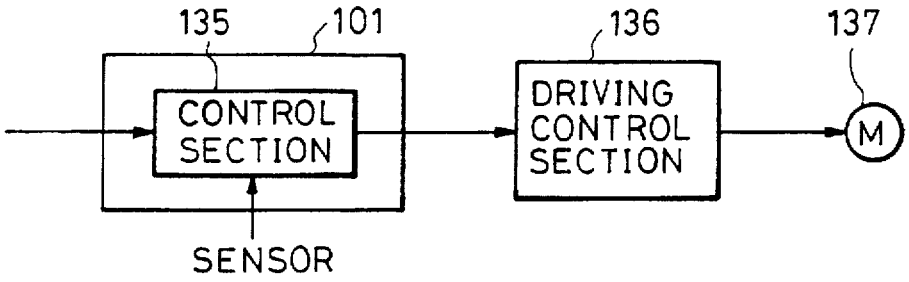
FIG. 4 is a control block diagram of the automatic sheet stacking device.

In FIG. 4, the means for determining how to stack sheets of paper 101 includes a control section (CPU) 135. The control section 135 receives information on the size of the output sheets sent out from the drawing output device 103 to decide how to stack the sheets and sends a control signal to the drive control section 136 for controlling the necessary number of rotation (or rotation angle) of the motor 137. The drive control section 136, which have received the control signal from the control section 135, sends a drive signal to the motor 137 to control rotation of the motor 137. In this case, information on the size of sent out sheets of paper is sent from the drawing output device 103 to the means for determining how to stack sheets of paper of the automatic device for stacking sheets of paper 100 through a connector.

Further, in case where there is disposed a sensor (not indicated in the figures) supervising working region of the sheet guiding plate pivoting means 111, the automatic device for stacking sheets of paper is so constructed that working of the sheet guiding plate pivoting means 111 (i.e. rotation of the motor 137) is controlled by feeding back a detection signal from the sensor to the control section 135 (or the drive control section 136).

Figure 5A:
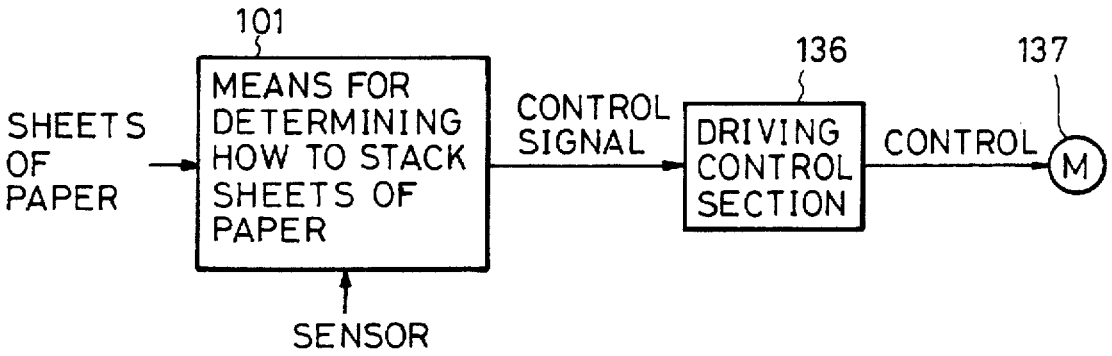
FIGS. 5A, 5B and 5C are other control block diagrams (alternative plan) for the automatic sheet stacking device.
Figure 5B:
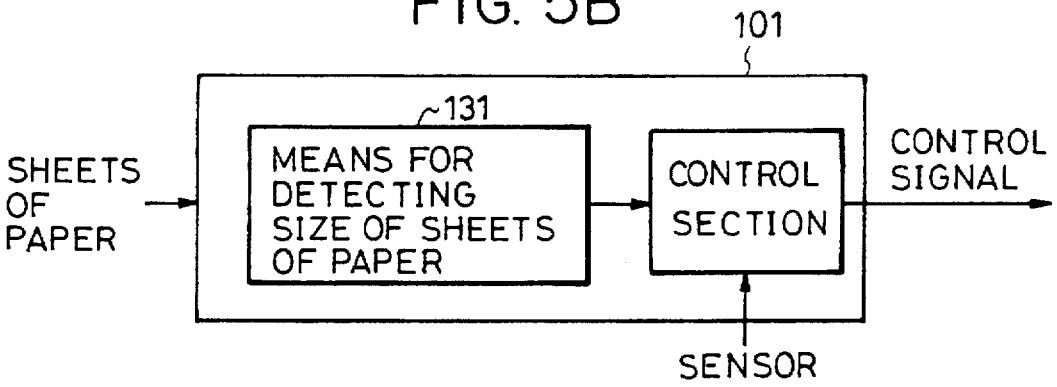
Figure 5C:
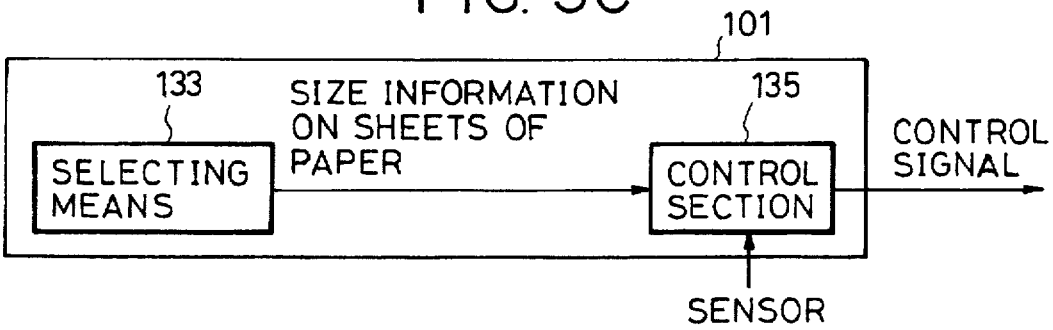

FIGS. 5A, 5B and 5C are block diagrams indicating different working modes of the means for determining how to stack sheets of paper 101 in case where the information on the size of the sheet is not sent out from the drawing output device 103, but it is obtained by the automatic device for stacking sheets of paper 100 itself (i.e. in case where the automatic device for stacking sheets of paper 100 is constructed as stand alone). In the example indicated in FIG. 5A, it is composed of sheet judging means 131 (e.g. a limiter switch, an optical sensor, etc.) disposed in the neighborhood of a sheet receiving opening of the automatic device for stacking sheets of paper 100, which judges the size of sheets and the control section 135 (e.g. CPU), which decides on the basis of the information on the size of the judged sheets of paper whether the output sheets 102 should be stacked in the stacking tray or hung on the sheet hanging bar 115 and sends out a control signal.

Further, as an alternative plan of the case where the automatic device for stacking sheets of paper 100 is stand alone, selecting means 133 such as an operation panel, a button, a switch, etc. may be disposed in the automatic device for stacking sheets of paper 100 and the means for determining how to stack sheets of paper 101 may be composed of the selecting means 133 and the control section 135 (refer to FIG. 5B) so that when an operator gives the device for stacking sheets of paper 100 information on the size of the sheets of paper or information for selecting how to stack the sheets of paper by operating selecting means, the control section 135 (e.g. CPU) decides on the basis of the given information whether the output sheets 102 should be stacked in the stacking tray 105 or hung on the hanging bar 115 to send out a control signal. A stepping motor, etc., which are well-known, can be used for the driving motor 137.

The moving bar 107 has a bar-shaped form and is mounted pivotably on the supporting arms 108—108. It is so constructed that it can be moved upward and downward by the driving shaft 106 through the supporting arms 108—108 and the sheet guiding plate 111 is formed in a plate-shape.

In case where it is decided by the means for determining how to stack sheets of paper 101 that the output sheets 102 should be hung on the sheet hanging bar 115, since the roller 112' of the drive arm 112 is pivoted by the driving shaft 106, until it is approximately vertically downward, the sheet guiding plate (sheet guiding means) 111 is held approximately in a horizontal state between the supporting arms 108—108. When it is in this state, the sheets of paper 102 sent out from the sheet sending out opening 104 are guided to the outer side of the hanging bar (sheet hanging bar) 115 and hung there. Thereafter the sheets of paper are hung on the hanging bar 115 for every predetermined length to be stacked by movements of the sheet 102, the driving shaft 106, the drive arms 112 and the sheet guiding plate 111. A concrete example of the movements will be described later (refer to FIGS. 8A to 8F and FIGS. 10A and 10B).

In case where it is decided by the means for determining how to stack sheets of paper 101 that the output sheets 102 should be stacked in the stacking tray 105, since the rollers 112' of the drive arms 112 are pivoted counter-clockwise, the auxiliary roller 110 is driven to the neighborhood of the main roller 116 (or until it is brought almost into contact therewith). Therefore the sheet guiding plate 111 leaves the space comprised between the two supporting arms 108—108 and keeps a state where it is inclined to the left (refer to FIGS. 10A and 10B).

At this time, since the feed motor 119 linked with the main rollers 116 and 117 is driven by the control signal coming from the control section 125, the sheets 102 sent out from the sheet sending out opening 104 are carried upward to be guided to the stacking tray 105 through the carrying path within the sheet guide 118. Thereafter the sheets of paper 102 are stacked in the stacking tray by movement of the sheets 102, the driving shaft 106, the drive arms 112 and the sheet guiding plate 111 and a concrete example of the movements thereof will be explained in the following Embodiment (refer to FIGS. 9A to 9C and FIGS. 10A and 10B).

EMBODIMENT

Figure 6:
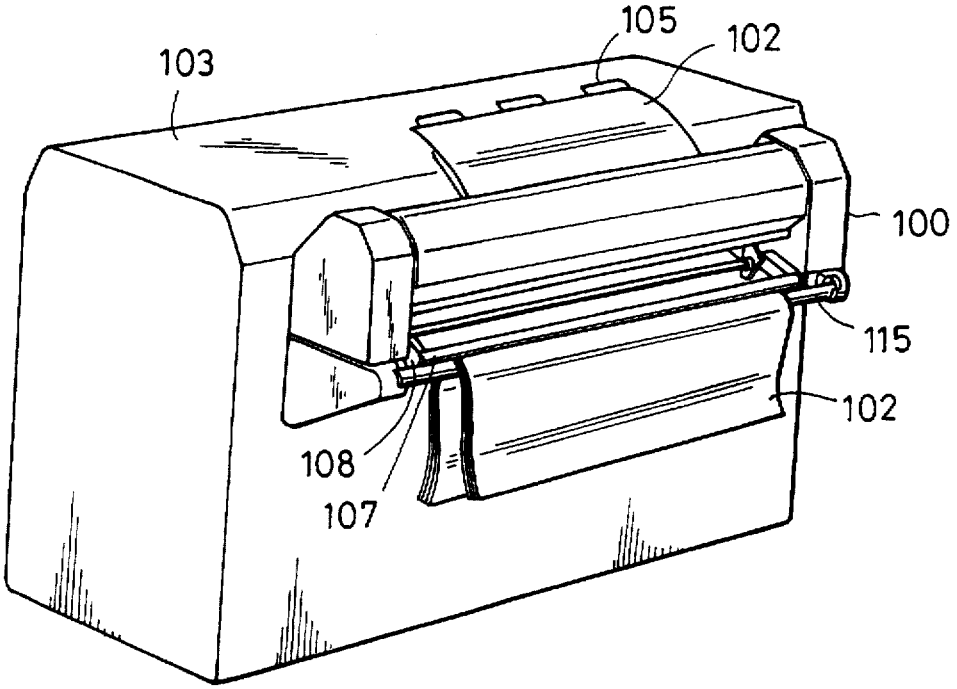
FIG. 6 is a perspective view of an external appearance of an embodiment of the automatic sheet stacking device according to the present invention.

FIG. 6 is a perspective view showing an appearance of an embodiment of the automatic device for stacking sheets of paper 100, in which the automatic device for stacking sheets of paper 100 mounted on a drawing output device 103, a sheet hanging bar 115, which is a part of the construction thereof, a stacking tray and sheets of paper 102 stacked therein are shown.

Figure 7:
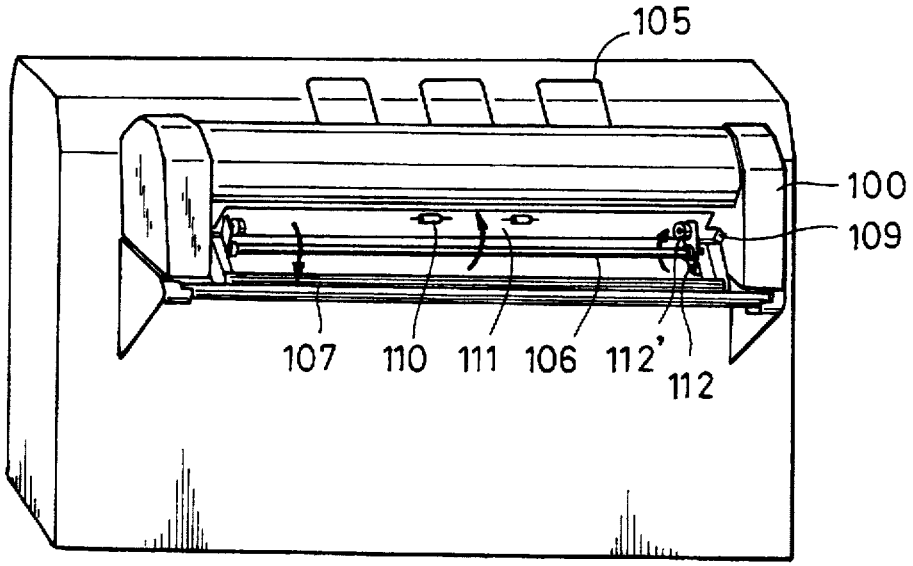
FIG. 7 is a perspective view of an external appearance of the automatic sheet stacking device, in case where sheets of paper are stacked in a tray.

FIG. 7 is a perspective view showing an appearance of the automatic device for stacking sheets of paper 100, in case where sheets of paper are stacked in the stacking tray 105. When a sheet of paper to be stacked in the stacking tray is sent out from the drawing output device 103, since the bar-shaped moving bar 107 descends and the sheet guiding plate 111 is displaced to the carrying path side for carrying sheets of paper to the stacking tray, the sheet passes through the carrying path within the automatic device for stacking sheets of paper 100 to be stacked in the stacking tray 105. Thereafter the moving bar 107 descends and the sheet guiding plate 111 returns to the original position thereof.

FIGS. 8A to 8F are diagrams for explaining operations of the automatic device for stacking sheets of paper 100, when sheets of paper 102 are hung on the hanging bar 115.

Figure 8A:
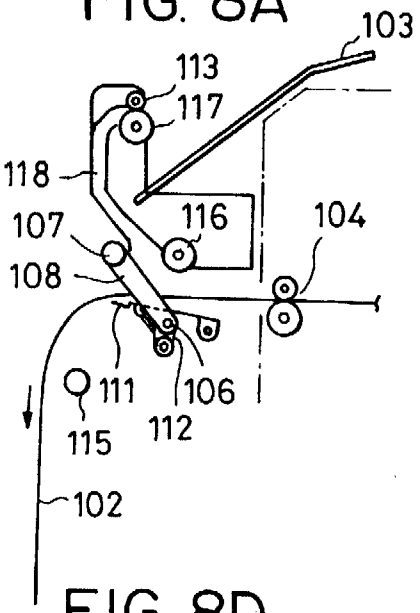
FIGS. 8A to 8F are diagrams for explaining operation of the automatic sheet stacking device, when sheets of paper are hung on a hanging bar.
Figure 8B:
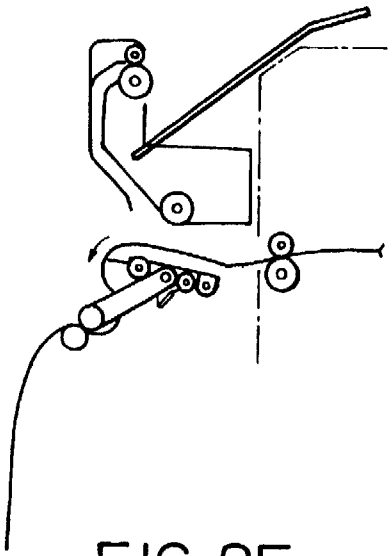
Figure 8C:
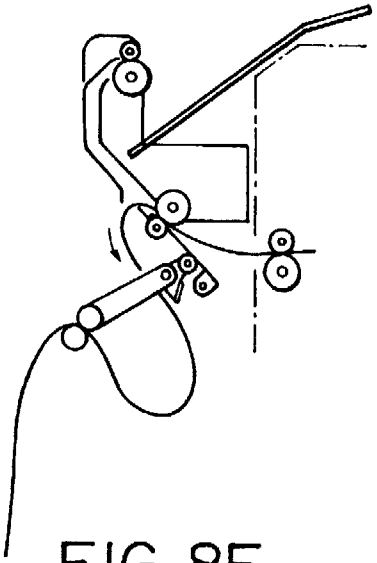

FIG. 8A shows initial positions of the moving bar 107 and the sheet guiding plate 111. The sheet guiding plate 111 pivoted by the driving shaft 106, until the roller 112' of the drive arm 112 is almost vertically downward, is held in an almost horizontal state between the supporting arms 108—108. In case where the means for determining how to stack sheets of paper 101 decides that output sheets should be hung on the sheet hanging bar 115, since the moving bar 107 and the sheet guiding plate 111 keep the initial positions thereof at first, the sheets of paper 102 sent out through the sheet sending out opening 104 are guided to the outer side of the sheet hanging bar 115 and hung there (refer to FIG. 8A).

Next, the driving shaft 106 pivots and the drive arm 112 pivots (counterclockwise in the figure), until the moving bar 107 thrusts the sheet of paper 102 to the sheet hanging bar 115. In this case, the moving bar 107 pivots, following the drive arm 112, until it thrusts the sheet of paper 102 to the sheet hanging bar 115, and it stops, when it reaches the sheet hanging bar 115 (or sheets of paper hung thereon). However, since the drive arm 112 and the supporting arms 108—108 of the moving bar 107 are linked by a linking arm or an arm spring 120, the moving bar 107 continues to press the sheets of paper 102 to the sheet hanging bar 115 (refer to FIGS. 8B to 8F). Further pivoting speed of the driving shaft 106 is synchronized with sending out speed of the sheets of paper, and when a point located at about a half of the predetermined length of the sheets of paper reaches approximately the summit of the sheet hanging bar 115, the control section 135 sends out a control signal to the driving control section 136 so that the moving bar 107 presses the sheets of paper in the neighborhood of the summit. In this way, the sheets of paper 102 is pressed to the sheet hanging bar 115 at the point located at about a half of the predetermined length thereof. The rest of the sent out sheet of paper 102 is bent from the neighborhood of the uppermost side of the sheet guiding plate 111 towards the inner side (right-hand side in the figure) of the sheet hanging bar 115 and begins to hang down.

Thereafter also, the moving bar 107 presses about the middle of the sheets of paper, owing to the function of the arm spring 120 and the drive arm 112 continues to pivot in the same direction to push the sheet guiding plate 111 upward. In this way, at last the sheet guiding plate 111 raises the remaining second half of the sheet and the auxiliary roller 110 presses the second half of the sheet 102 towards the main roller 116. Therefore the sheet is sent forward and hanging of the sheet from the neighborhood of the uppermost side of the sheet guiding plate 111 towards the inner side (right-hand side in the figure) of the sheet hanging bar 115 is accelerated (refer to FIG. 8C).

Figure 8D:
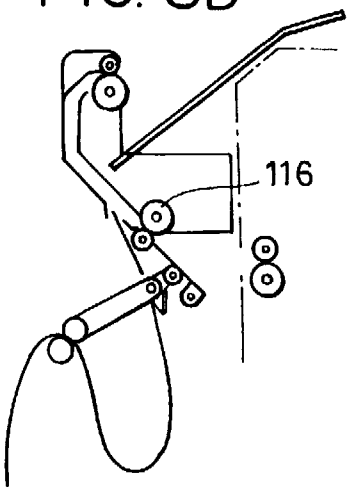
Figure 8E:
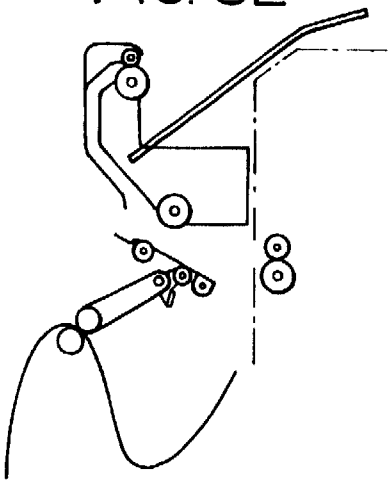
Figure 8F:
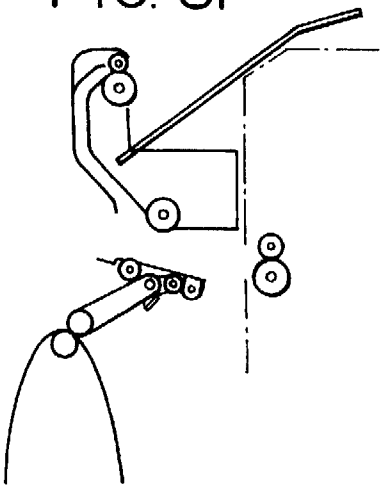

In the meantime, when the length of the sheet of paper sent out from the sheet sending out opening reaches a predetermined value, since the end portion of the sheet of paper is in a position, where the main roller 116 has no influences thereon, it can take place that the sheet of paper becomes entangled in the neighborhood of the uppermost side of the sheet guiding plate 111 and that the sheet of paper does not hang (refer to FIG. 8D). By way of precaution against it, since the control section 135 can know on the basis of the rotational angle and speed of the driving shaft 106 whether the sheet of paper has moved by the predetermined length or not, it makes the drive arm 112 pivot in the reverse direction (clockwise in the figure), when it knows that the sheet of paper has moved by the predetermined length. Therefore the sheet guiding plate 111 descends to work so as to shake down the rest of the sheet of paper 102.

which has been entangled. In this way, all the rest of the sheet of paper 102 is hung on the inner side of the hanging bar 115 (refer to FIGS. 8E and 8F), and as the result sheets of paper are stacked on the hanging bar 115. Further, since the sheet thrusting bar 107 continues to press the sheets of paper thus stacked towards the hanging bar 115 owing to the action of the arm spring 120, no state, in which sheets of paper, which have been just stacked, are deviated or bulged at the middle portion, takes place (refer to FIG. 8F) so that the sheets of paper can be held stably. Thereafter, in case where there is no sheet of paper which is to be hung on the sheet hanging bar 115, the drive arm 112 is pivoted in the reverse direction and the moving bar 107 and the sheet guiding plate 111 return to the initial positions thereof.

Figure 9A:
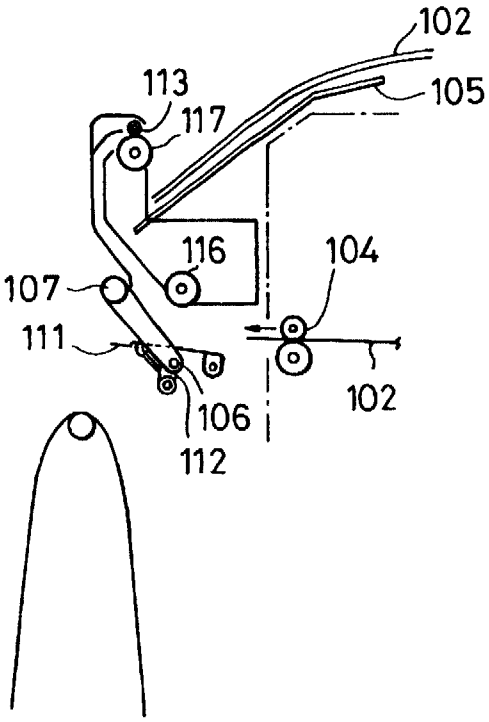
FIGS. 9A to 9C are diagrams for explaining operation of the automatic sheet stacking device, when sheets of paper are stacked in a tray.
Figure 9B:
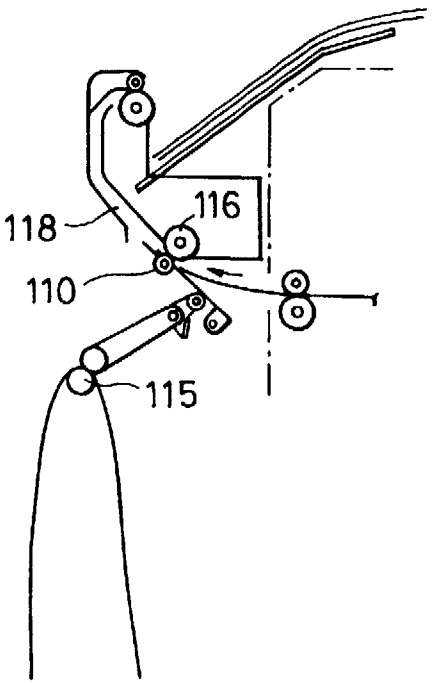
Figure 9C:
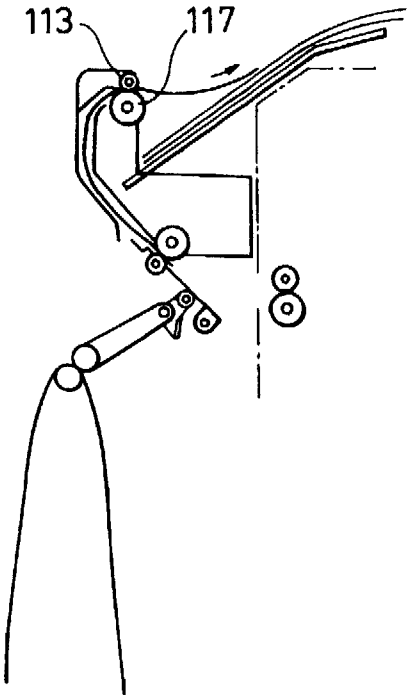

FIGS. 9A to 9C are diagrams for explaining operations of the automatic device for stacking sheets of paper 100, when sheets of paper 102 are stacked in a stacking tray 105.

FIG. 9A shows initial positions of the moving bar 107 and the sheet guiding plate 111, similarly to FIG. 8A described previously.

Next, when a sheet of paper 102 is sent out from the sheet sending out opening 104 and it is decided by the means for determining how to stack sheets of paper 101 that output sheets of paper 102 should be stacked in the stacking tray 105, the driving shaft 106 pivots by a predetermined angle in the direction, in which the drive arm 112 raises the sheet guiding plate 111 (counterclockwise in the figure). Since the drive arm 112 raises the sheet guiding plate 111 to such a height that the auxiliary roller 110 of the sheet guiding plate 111 is brought into contact with the main roller 116, the sent out sheet of paper 102 is put between the main roller 116 and the auxiliary roller 110 to be carried upward and introduced into the carrying path 118 (refer to FIG. 9B). At this time, the moving bar 107 is in such a position that it pushes the sheet hanging bar 115.

In this way, the sheet of paper 102 is carried, the extremity thereof being put between the main roller 117 and the auxiliary roller 113, and at last it is stacked in the stacking tray 105 (refer to FIG. 9C). Thereafter, in case where there are no more sheets of paper, which are to be stacked in the stacking tray, the drive arm 112 is pivoted in the reverse direction and the moving bar 107 and the sheet guiding plate 111 return to the initial positions thereof.

In the above explanation, it is supposed that the sheets of paper are sent out in unit of a sheet having a normalized size or a continuous sheet of paper is cut on the side of the drawing output device 103, which sends out sheets of paper having a predetermined size. However it is possible also that cutting of the continuous sheet of paper is effected on the side of the automatic device for stacking sheets of paper 100.

In this case it is sufficient to construct the automatic device for stacking sheets of paper 100 so that a cutter operated by a control signal coming from the control section 135 is disposed at a suitable position between the sheet sending out opening 104 and the sheet guiding plate 111.

FIGS. 10A and 10B are diagrams showing the principal part of the automatic device for stacking sheets of paper 100. FIG. 10A indicating the initial position, while FIG. 10B indicates the maximum pivoting position of the drive arm 112.

Similarly to FIG. 1, in FIGS. 10A and 10B, there are indicated the moving bar 107 acting as sheet thrusting means; the supporting arms 108 of the moving bar; the supporting shaft 109 of the sheet guiding plate 109; the auxiliary roller 110; the sheet guiding plate 111 acting as sheet guiding means; the roller 112 disposed at the extremity of the drive arm 112 acting as sheet guiding plate pivoting means; the auxiliary roller 113; the sheet hanging bar 115 acting as sheet supporting means; the main rollers 116 and 117; and the carrying path 118. 119 represents a feed motor driving the main rollers 116 and 117. Here, although the sheet supporting means 115 includes a hanging bar and a supporting table, which supports the hanging bar mountably and dismountably, only the hanging bar is indicated in the figure and the supporting table is omitted. Further the hanging bar is disposed parallelly to the sheet sending out opening 104 of the drawing output device (refer to FIG. 1).

In FIGS. 10A and 10B, double circles indicating the moving bar 107 and the sheet hanging bar 115 mean that outer surfaces thereof are covered with friction material or it is applied thereto. It is desirable to cover the moving bar 107 and the sheet hanging bar 115 with friction material in order to prevent slip or displacement of sheets of paper. Further, in order to prevent idling of rollers and to make transportation of sheets of paper sure, there is disposed a thrusting spring 110' so as to push the auxiliary roller 110 towards the main roller 116. Similarly, in order to make the sheets of paper 102 pass through the carrying path 118 and to stack them smoothly in the stacking tray 105, the thrusting plate 113' is used so as to push the auxiliary roller 113 towards the main roller 117.

Figure 11:
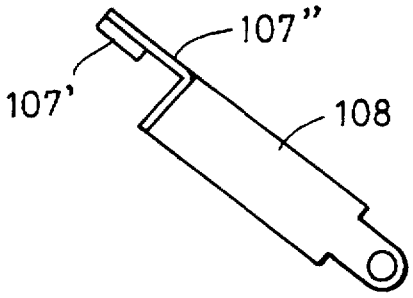
FIG. 11 is a diagram showing the construction of an alternative plan of the sheet thrusting means.

FIG. 11 shows a moving angle 107" as an alternative plan for the sheet thrusting means. The moving angle 107" consists of an angle mounted pivotably at the extremity of the supporting arm 108 and a friction material 107' stuck to the lower surface of the extremity portion thereof. It can press down surely the sheets of paper 102 hung on the hanging bar 115 in the longitudinal direction of the hanging bar 115 owing to the fact that the angle is mounted pivotably.

Figure 12:
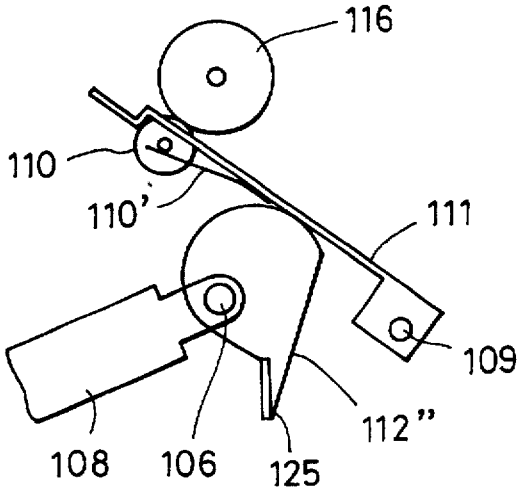
FIG. 12 is a diagram showing the construction of an alternative plan of the sheet guiding plate pivoting means.

FIG. 12 shows a cam 112" as an alternative plan for the sheet guiding plate pivoting means 112. As indicated in the figure, the cam 112" has a protruding grip 125 at the extremity so that when it pivots clockwise, it raises the supporting arm 108. In the figure, when the cam 112" is pivoted counterclockwise by the driving shaft 106, it raises the sheet guiding plate 111. In case where it returns to the initial position thereof, since the cam 112" is pivoted clockwise by the driving shaft 106 while being in contact with the rear surface of the sheet guiding plate 111, the sheet guiding plate 111 returns gradually to a horizontal position. In the meantime, the supporting arm 108 is lifted by the grip 125 and the moving angle 1071 moves upward. The sheet guiding plate 111 can move more smoothly up- and downward owing to use of the cam and drive efficiency is improved.

Figure 13:
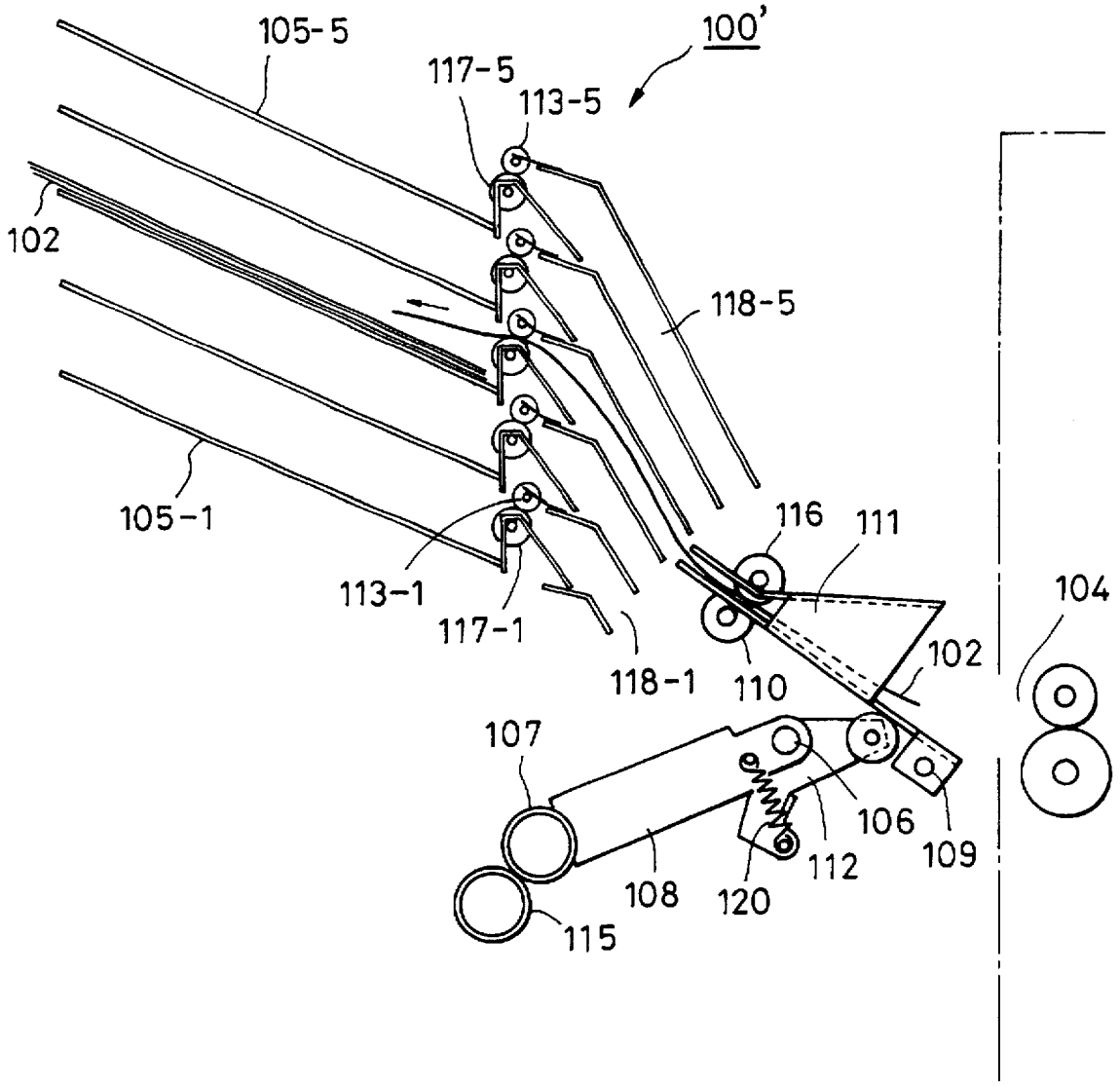
FIG. 13 is a diagram showing the construction of a multi-layered type automatic device for stacking sheets of paper, which is another embodiment of the automatic device for stacking sheets of paper according to the present invention.
Figure 14:
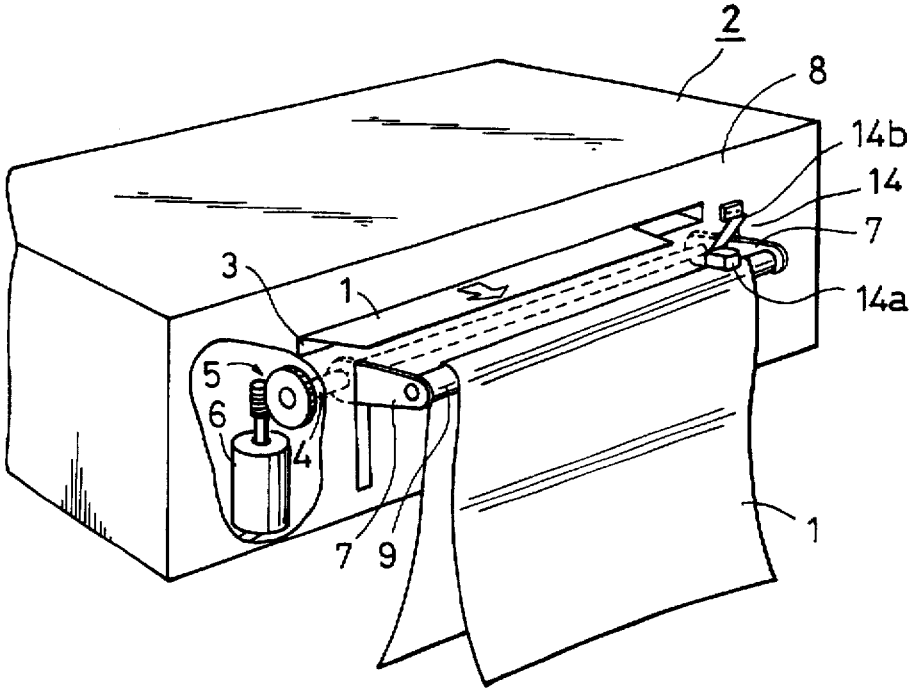
FIG. 14 PRIOR ART
FIG. 14 is a perspective view of an example of a prior art automatic device for stacking sheets of paper.
Figure 15:
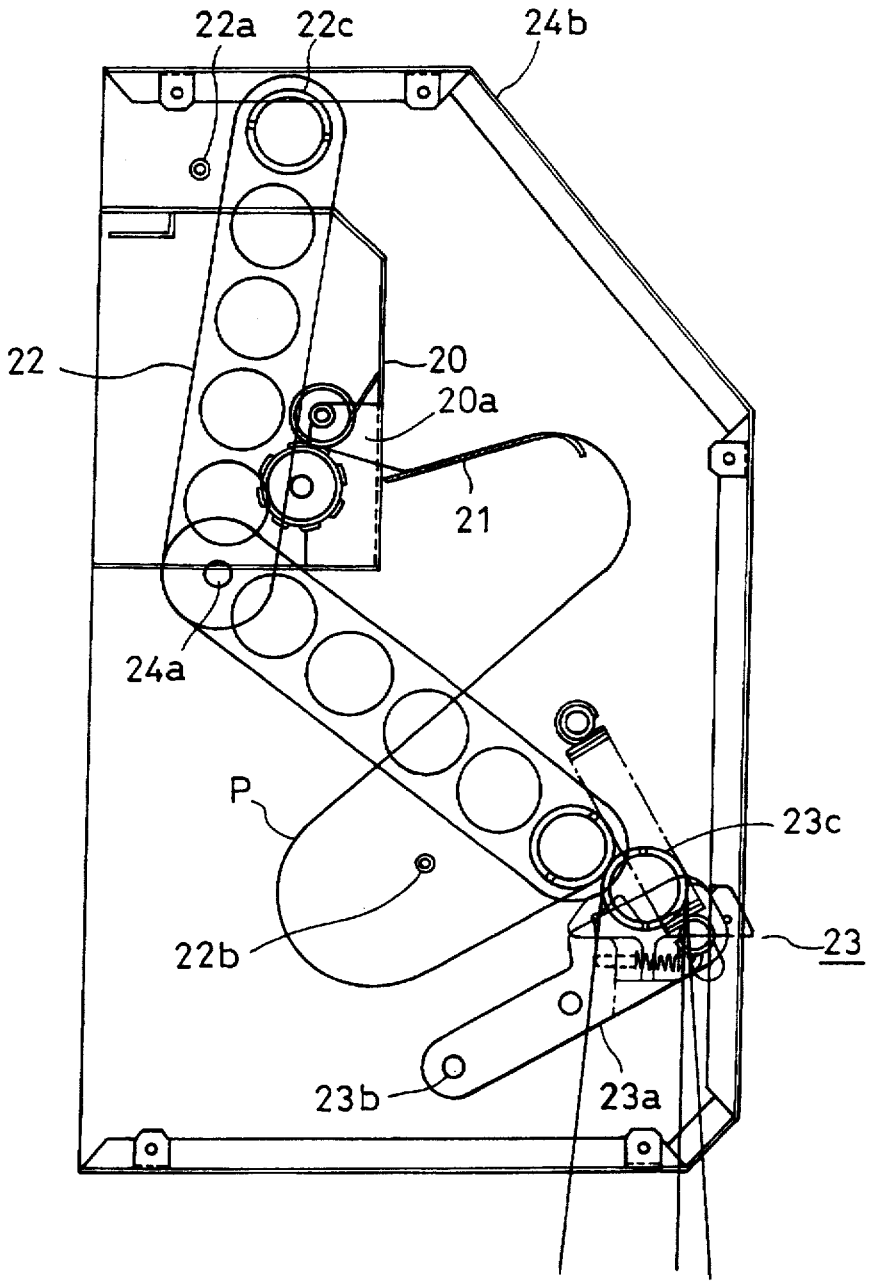
FIG. 15 PRIOR ART
FIG. 15 is a diagram showing an example of another prior art automatic device for stacking sheets of paper.
Figure 16:
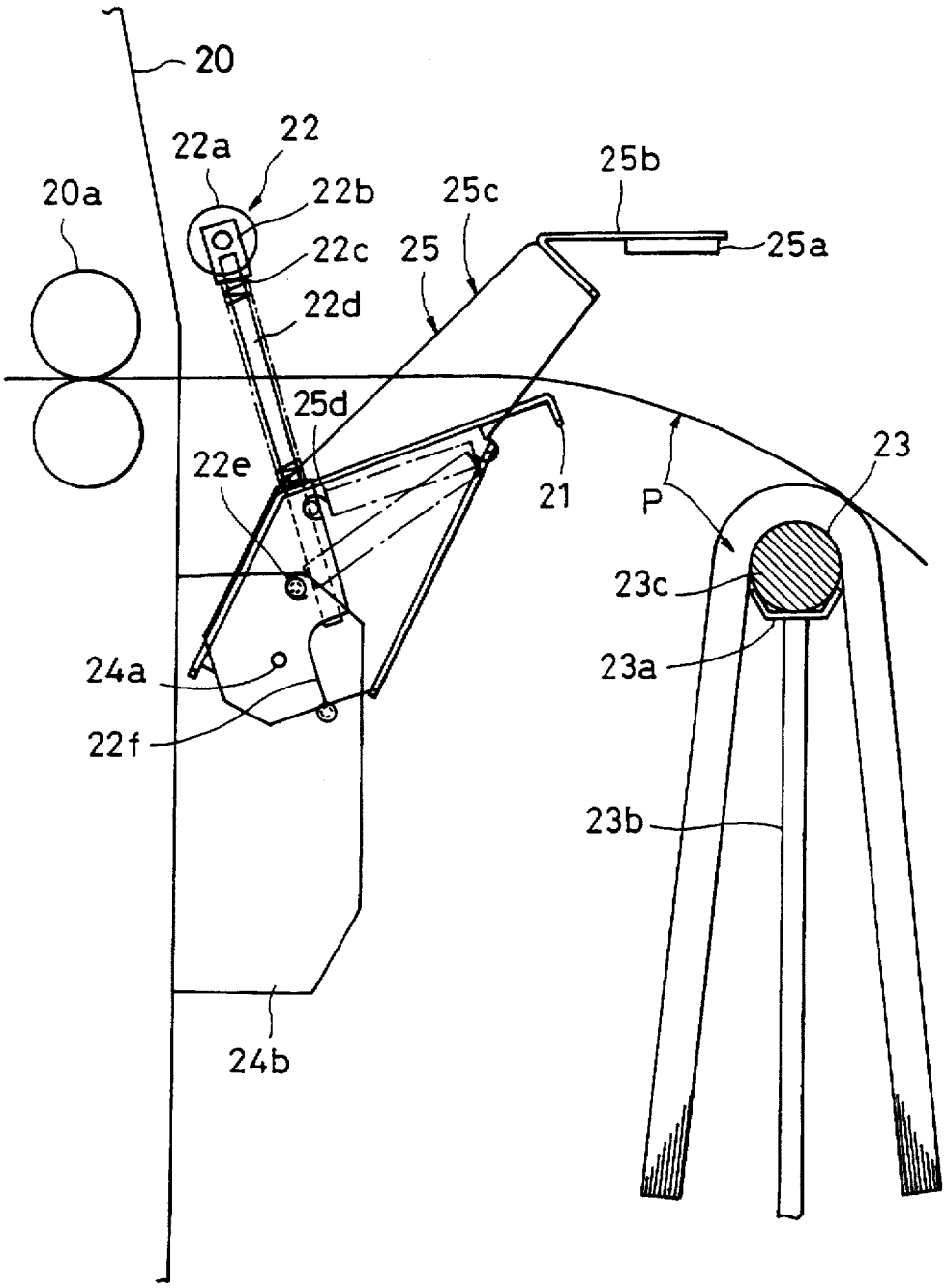
FIG. 16 PRIOR ART
FIG. 16 is a diagram showing an example of still another prior art automatic device for stacking sheets of paper.

FIG. 13 shows the construction of another embodiment of the automatic device for stacking sheets of paper according to the present invention. The automatic device for stacking sheets of paper in the present embodiment is constructed in the form of a multi-layered type automatic device for stacking sheets of paper 100', in which there are disposed a plurality of sheet carrying paths and stacking trays and sheets of paper apart from sheets, which are to be hung, can be classified according to their size to be stacked in corresponding different trays.

The automatic device for stacking sheets of paper 100' differs from the automatic device for stacking sheets of paper 100 indicated in FIG. 1 in that the former is provided with trays 105-1 to 105-5, carrying paths 118-1 to 118-5, auxiliary roller 113-1 to 113-5, and main rollers 117-1 to 117-5; that the former is provided with a roller moving mechanism (not indicated in the figure), which makes the position of the main roller 116 itself introducing the sheets of paper 102 guided by the sheet guiding plate 111 to corresponding carrying paths 118-i into the stacking trays 105-1 to 105-5 to carry them movable in order to guide the sheets of paper to the respective carrying paths 118-i according to the corresponding kind of sheets of paper; and that the carrying paths and the stacking trays are located in the direction opposite to those in the automatic device for stacking sheets of paper 100 indicated in FIG. 1. However, since the other constituent parts are identical to those in the automatic device for stacking sheets of paper 100 indicated in FIG. 1 and further operations thereof are also identical to those described previously, explanation thereof will be omitted. Although 5 stacking trays, 5 carrying paths, 5 auxiliary rollers and 5 main rollers are indicated in FIG. 13, the number of them is not restricted to 5, but it may be any number, if it is at least 2. Further the carrying paths and the stacking trays may be located in the same direction as those indicated in FIG. 1.

Here a difference between the automatic device for stacking sheets of paper 100' and the automatic device for stacking sheets of paper 100 indicated in FIG. 1 consists in the positions of the sheet guiding means (sheet guiding plate) 111 and the main roller 116. In the present embodiment, in case where sheets of paper are stacked in stacking trays, the sheet guiding plate 111 is pivoted so that the sheets of paper are guided to corresponding carrying paths in order to guide the sent out sheets of paper to stacking trays decided for every size thereof.

That is, when a sheet of paper 102 is sent out from the sheet sending out opening 104 and it is decided by the means for determining how to stack sheets of paper 101 that the output sheet of paper 102 should be stacked in the stacking tray 105-1, the roller 116 is moved by the roller moving mechanism to a position, where the output sheet of paper 102 is introduced into the stacking tray 105-1, and the driving shaft 106 is pivoted in the direction, in which the sheet guiding plate pivoting means 112 raises the sheet guiding plate 111 (counterclockwise in the figure) by a predetermined angle to guide the sent out sheet of paper to the carrying path 118-1. Since the operation in case where the means for determining how to stack sheets of paper 101 decides that the output sheet 102 should be hung on the hanging bar is identical to that explained, referring to FIG. 1 (and FIG. 8), explanation thereof will be omitted.

As explained above, according to the present invention, since the automatic device for stacking sheets of paper is so constructed that hanging function for large size sheets of paper and stacking middle or small size sheets of paper can be effected selectively, in the device according to the first invention it is possible to hang large size output sheets of paper and to stack other sheets of paper in stacking trays.

In the automatic device for stacking sheets of paper according to the second embodiment of the invention, since there are disposed a plurality of stacking trays and corresponding carrying paths and it is decided according to information on the size of the sheets of paper whether they should be hung or stacked in stacking trays corresponding to different sizes of the sheets of paper, the sheet guiding plate being pivoted so that the sheets of paper are stacked at respective places, where they should be stacked, it is possible to obtain an automatic device for stacking sheets of paper capable of stacking output sheets of paper, putting them in order, independently from the sheet size. Concretely speaking, output sheets of paper of various sizes, i.e. from size E (norm) to size A (norm), can be arbitrarily classified to be stacked. In this way handling of sheets of paper can be improved.

In the automatic device for stacking sheets of paper according to the third embodiment of the invention, since information on the size of sheets from the drawing output device can be utilized, the construction can be simplified.

In the automatic device for stacking sheets of paper according to the fourth embodiment of the invention, by obtaining information on the size of sheets by detecting the size of sheets of paper sent out from the output device and in the automatic device for stacking sheets of paper according to fifth embodiment of the invention, since information on the size of the sheets of paper is inputted through an input section disposed in the automatic device for stacking sheets of paper, it is possible to provide a stand-alone type sheet stacking device, which can be used universally for arbitrary drawing output devices such as a large scale printer, a copier, etc.

Further, since the automatic device for stacking sheets of paper can be mounted in a simple manner on various devices such as a large scale plotter, a facsimile, a copier, etc., a large amount of sheets of paper coming from these output devices can be automatically stacked. For this reason this stacking device can be used in cooperative utilizations or unmanned operations in the night of various devices. Further, since the hanging bar for supporting sheets of paper can be dismounted from the supporting table, the sheets of paper stacked on the hanging bar can be dismounted together with the hanging bar to be stored by putting it on a hanger or a rack.

What is claimed is:

1. A sheet stacking apparatus, comprising:

a frame having an inlet for sheet stock having at least first and second sizes and a main roller rotatable about an axle mounted on said frame, an axis of said axle being oriented perpendicular to a direction of movement of said sheet stock moving therepast;

first and second sheet receiving means on said frame each adapted to receive therein said sheet stock of a selected one of said first and second sizes, said first sheet receiving means including a support means for supporting said sheet stock of said first size in an inverted U form and stacked array, said second sheet receiving means including at least one tray onto which said sheet stock of said second size is to be placed in a stacked array;

sheet guide means including a sheet guide member supported for movement between first and second positions for facilitating a guiding of said sheet stock to a respective one of said first and second sheet receiving means;

sheet stock size selection means for producing control signals indicative of a size of said sheet stock inputted to said inlet;

control means responsive to said control signals for controlling the movement of said sheet guide member to a respective one of said first and second positions so that said sheet stock fed to said input will be guided by said sheet guide member to respective said first and second sheet receiving means;

said sheet guide means including a sheet clamp member movable into and out of engagement with said support means in response to said sheet guide member being moved to and from said first position so as to effectively clamp said sheet stock supported on said support means between said sheet clamp member and said support means;

said sheet guide means additionally including an auxiliary roller mounted on said sheet guide member for movement with said sheet guide member toward and away from said main roller in response to a movement of said sheet guide member toward and away from said second position so that sheet stock of said second size will be guided by said sheet guide member between said main roller and said auxiliary roller; and said sheet guide means additionally including a separate lever arm movable independently of said sheet guide member between first and second positions, and link means interconnecting said lever arm, said sheet guide member and said sheet clamp member;

whereby sheet stock fed to said inlet will cause said control means, in response to a first of said control signals indicative of sheet stock of said first size, movement of said sheet guide member to said first position to guide said sheet stock to said first receiving means or, in response to a second of said control signals indicative of sheet stock of said second size, movement of said sheet guide member to said second position to guide said sheet stock to said second receiving means.

2. The sheet stacking apparatus according to claim 1, wherein said control means includes a drive motor responsive to said control signals and a shaft driven by said drive motor, said lever arm being affixed to said shaft and moved thereby, and wherein said sheet guide member is freely pivotally supported about a second axle parallel to said shaft and forcibly pivoted from said first position to said second position in response to said lever arm moving from said first position thereof to said second position thereof.

3. The sheet stacking apparatus according to claim 2, wherein said link means is a spring interconnecting said sheet guide member and said sheet clamp member.

4. The sheet stacking apparatus according to claim 1, wherein said sheet guide member is pivotally supported about a further axle at a first end thereof adjacent said inlet so that a leading edge of said sheet stock entering at said inlet will pass said first end and move toward a second end remote from said first end; and wherein said control means includes a drive motor responsive to said control signals, and a shaft parallel to said further axle driven by said drive motor, said lever arm being affixed to said shaft and moved thereby into and out of engagement with said sheet guide member at a location intermediate said first and second ends thereof to cause said sheet guide member to pivot between said first and second positions thereof.

5. The sheet stacking apparatus according to claim 4, wherein said link means is a spring interconnecting said sheet guide member and sheet clamp member; and wherein said sheet clamp member is urged by said spring into engagement with said support means only when said lever arm is in said first and second positions thereof.

6. The sheet stacking apparatus according to claim 1, wherein said sheet clamp member has at least one of a bar-shaped form and an angle-shaped form.

7. A sheet stacking apparatus, comprising: a frame having an inlet for sheet stock having at least first and second and third sizes and a main roller rotatable about an axle mounted on said frame, an axis of said axle being oriented perpendicular to a direction of movement of said sheet stock moving therepast;

first and second sheet receiving means on said frame each adapted to receive therein said sheet stock of a selected one of said first and second and third sizes, said first sheet receiving means including a support means for supporting said sheet stock of said first size in an inverted U form and stacked array, said second sheet receiving means including a plurality of trays onto selected ones of which respective said sheet stock of said second and third sizes are to be placed in a stacked array;

sheet guide means including a sheet guide member supported for movement between first and second positions for facilitating a guiding of said sheet stock to a respective one of said first and second sheet receiving means;

sheet stock size selection means for producing control signals indicative of a size of said sheet stock inputted to said inlet;

control means responsive to said control signals for controlling the movement of said sheet guide member to a respective one of said first and second positions so that said sheet stock fed to said input will be guided by said sheet guide member to respective said first and second sheet receiving means;

said sheet guide means including a sheet clamp member movable into and out of engagement with said support means in response to said sheet guide member being moved to and from said first position so as to effectively clamp said sheet stock supported on said support means between said sheet clamp member and said support means;

said sheet guide means additionally including an auxiliary roller mounted on said sheet guide member for movement with said sheet guide member toward and away from said main roller in response to a movement of said sheet guide member toward and away from said second position so that sheet stock of said second and third sizes will be guided by said sheet guide member between said main roller and said auxiliary roller; and said sheet guide means additionally including a separate lever arm movable independently of said sheet guide member between first and second positions, and link means interconnecting said lever arm, said sheet guide member and said sheet clamp member;

whereby sheet stock fed to said inlet will cause said control means, in response to a first of said control signals indicative of sheet stock of said first size, movement of said sheet guide member to said first position to guide said sheet stock of said first size to said first receiving means or, in response to a second of said control signals indicative of sheet stock of said second and third size, movement of said sheet guide member to said second position to guide said sheet stock to said second receiving means.

8. The sheet stacking apparatus according to claim 7, wherein said control means includes a drive motor responsive to said control signals and a shaft driven by said drive motor, said lever arm being affixed to said shaft and moved thereby, and wherein said sheet guide member is freely pivotally supported about a second axle parallel to said shaft and forcibly pivoted from said first position to said second position in response to said lever arm moving from said first position thereof to said second position thereof.

9. The sheet stacking apparatus according to claim 8, wherein said link means is a spring interconnecting said sheet guide member and said sheet clamp member.

10. The sheet stacking apparatus according to claim 7, wherein said sheet guide member is pivotally supported about a further axle at a first end thereof adjacent said inlet so that a leading edge of said sheet stock entering at said inlet will pass said first end and move toward a second end remote from said first end; and wherein said control means includes a drive motor responsive to said control signals, and a shaft parallel to said further axle driven by said drive motor, said lever arm being affixed to said shaft and moved thereby into and out of engagement with said sheet guide member at a location intermediate said first and second ends thereof to cause said sheet guide member to pivot between said first and second positions thereof.

11. The sheet stacking apparatus according to claim 10, wherein said link means is a spring interconnecting said sheet guide member and sheet clamp member; and wherein said sheet clamp member is urged by said spring into engagement with said support means only when said lever arm is in said first and second positions thereof.

12. The sheet stacking apparatus according to claim 7, wherein said sheet clamp member has at least one of a bar-shaped form and an angle-shaped form.

* * * * *